US009139335B2

(12) United States Patent
Månsson

(10) Patent No.: US 9,139,335 B2
(45) Date of Patent: Sep. 22, 2015

(54) TRANSPORT UNIT AND METHOD FOR MANUFACTURING OF THE SAME

(75) Inventor: Evert Månsson, Skummeslövsstrand (SE)

(73) Assignee: Ecolean AB, Helsingborg (SE)

( * ) Notice: Subject to any disclaimer, the term of this patent is extended or adjusted under 35 U.S.C. 154(b) by 0 days.

(21) Appl. No.: 14/130,889

(22) PCT Filed: Jul. 4, 2011

(86) PCT No.: PCT/EP2011/061235
§ 371 (c)(1),
(2), (4) Date: Feb. 19, 2014

(87) PCT Pub. No.: WO2013/004293
PCT Pub. Date: Jan. 10, 2013

(65) Prior Publication Data
US 2014/0196634 A1 Jul. 17, 2014

(51) Int. Cl.
*B65D 19/44* (2006.01)
*B65D 71/00* (2006.01)
*B65D 85/672* (2006.01)
(Continued)

(52) U.S. Cl.
CPC ..... *B65D 19/44* (2013.01); *B65D 71/0096* (2013.01); *B65D 71/02* (2013.01); *B65D 85/672* (2013.01); *B65B 27/06* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00815* (2013.01); *B65D 2571/00043* (2013.01); *Y10T 29/4995* (2015.01)

(58) Field of Classification Search
CPC ..... B65D 19/44; B65D 71/02; B65D 19/36; B65D 85/04; B65D 19/38; B65D 2519/00815
USPC ..... 206/389, 393, 394, 408, 386, 597; 108/55.5, 55.1, 55.3
See application file for complete search history.

(56) References Cited

U.S. PATENT DOCUMENTS 2,160,235 A 5/1939 Slusar
2,507,588 A * 5/1950 Brandon et al. ..... 108/51.3
(Continued)

FOREIGN PATENT DOCUMENTS

CN 101448712 A 6/2009
EP 0 446 736 A1 9/1991
(Continued)

OTHER PUBLICATIONS

International Search Report and Written Opinion mailed Mar. 2, 2012, issued in corresponding International Application No. PCT/EP2011/061235, filed Jul. 4, 2011, 9 pages.
(Continued)

*Primary Examiner* — Steven A. Reynolds
(74) *Attorney, Agent, or Firm* — Christensen O'Connor Johnson Kindness PLLC

(57) ABSTRACT

A transport unit including a load carrier (9) and a load (18) supported by said load carrier (9) and including a coil (1) of a web (3) being wound on a reel (4). A load securing member (25) extends inside the reel (4) and between the load carrier (9) and an anchoring device (24) arranged on a top surface (20) of the load (18) such that the load (18) is secured to the load carrier (9). The invention also relates to a method for manufacturing a transport unit.

19 Claims, 10 Drawing Sheets

(51) Int. Cl.

| | |
|---|---|
| ***B65D 71/02*** | (2006.01) |
| *B65B 27/06* | (2006.01) |

(56) References Cited

U.S. PATENT DOCUMENTS

| | | | | | |
|---|---|---|---|---|---|
| 2,625,317 | A * | 1/1953 | MacChesney | 206/416 |
| 3,004,746 | A * | 10/1961 | Swingle | 410/35 |
| 3,419,138 | A | 12/1968 | Halsberghe | |
| 3,541,977 | A * | 11/1970 | Waldman | 108/53.1 |
| 4,257,523 | A * | 3/1981 | Blasio | 206/303 |
| 4,829,909 | A * | 5/1989 | Mandel | 108/55.5 |
| 4,890,560 | A * | 1/1990 | Good | 108/53.1 |
| 5,105,943 | A * | 4/1992 | Lesko et al. | 206/397 |
| 5,340,180 | A * | 8/1994 | Chase et al. | 294/68.1 |
| 5,355,786 | A | 10/1994 | Tipton | |
| 5,515,977 | A * | 5/1996 | Lambert | 206/597 |
| 5,819,934 | A * | 10/1998 | Cooper | 206/397 |
| RE37,575 | E * | 3/2002 | Lambert | 206/597 |
| 7,331,457 | B2 * | 2/2008 | Cipriani | 206/408 |
| 7,766,170 | B2 * | 8/2010 | Mansson et al. | 206/597 |
| 8,505,469 | B2 * | 8/2013 | Liu et al. | 108/56.3 |
| 2001/0013479 | A1 | 8/2001 | Giancarlo | |
| 2004/0211694 | A1 | 10/2004 | Coon | |
| 2009/0166235 | A1 * | 7/2009 | Mansson et al. | 206/391 |

FOREIGN PATENT DOCUMENTS

| | | |
|---|---|---|
| GB | 296 638 A | 9/1928 |
| WO | 0058181 | 10/2000 |
| WO | 2008/013486 A1 | 1/2008 |

OTHER PUBLICATIONS

International Preliminary Report on Patentability mailed Jul. 17, 2013, issued in corresponding International Application No. PCT/EP2011/061235, filed Jul. 4, 2011, 13 pages.

Notice of Reason for Rejection mailed Jan. 7, 2015, issued in corresponding Chinese Application No. 201180071934.9, filed Jul. 4, 2011, 4 pages.

* cited by examiner

TRANSPORT UNIT AND METHOD FOR MANUFACTURING OF THE SAME

FIELD OF THE INVENTION

The present invention relates to a transport unit in the form of a load carrier which supports a load comprising at least one coil of a web being wound on a reel. The invention also concerns a method of manufacturing such a transport unit.

BACKGROUND ART

The invention is suitable for transport units which comprise coils of container blanks which in a filled state form flexible containers of a collapsible type.

A container blank is an empty, pre-made container which is supplied to a filling machine in order to produce filled containers.

A container of collapsible type is also referred to as a stand-up pouch, and by a container of collapsible type is thus meant a container with walls of a flexible plastic material, which are flexible and connected to each other to define a compartment, whose volume is dependent on the relative position of the walls. In its unfilled state, the container, and thus its container blank, is flat. The container blanks can be provided in a form of a coil, in which a continuous web of container blanks is wound on a reel.

One example of a container of a collapsible type comprises three wall portions, of which two form opposite side walls and a third forms a bottom wall. The container blanks for this type of containers can be made, for instance, by folding a continuous web of material in the form of an M, after which the wall portions are joined along a connecting portion to define a closed compartment. The container blanks can also be made by joining three continuous webs of material, one of which is folded in the form of a V to form the above-mentioned bottom wall. Regardless of method, this results in a continuous web of container blanks which, seen in the transverse direction of the web, have a first portion with a first number of layers (two walls) and a second portion with a second number of layers (four walls). When winding such a web on a reel, a coil is obtained, which in the first portion has a first density and in the second portion has a second density. This difference in density causes problems in handling, packing and transport of the coils.

Due to the difference in density, the coils cannot be stacked on top of each other without problems of instability and interleaving of the turns of two coils stacked on each other. Such instability and interleaving may cause "upsetting" and damage to the container blanks.

In order to prevent this, the coils may be transported one by one in separate boxes. This results in unnecessary costs and also an environmental problem in the form of unnecessary packing.

Alternatively, the load in form of one or more coils each comprising a web being wound on a reel may be arranged on a pallet type load carrier. An example of such a transport unit is disclosed in WO2008/013486 A1. The transport unit disclosed therein has a load distributing element arranged on top of the load and a tightening strap encloses a force-absorbing structure formed by the load carrier, the reel and the load distributing element and is thus adapted to secure the load to the load carrier. With such a transport unit, the reel of the coil in combination with the load carrier and the load distributing element is used to form a force-absorbing structure. By the load distributing element being arranged on the upper surface of the load, the tightening force applied by the tightening strap will be absorbed by the force-absorbing structure.

The overall cost for this alternative transport unit is considerably lower that the cost involved for transporting coils in separate boxes. However, a further reduced cost would still be favourable.

The load distributing element may be in the form of a wood board, and in some cases the tightening force applied by the tightening strap may cause the wood board to bend, which may cause deformation of the web of coil. Such deformation of the web may cause problems when using the container blanks of the web in a filling machine. More particular, the deformation may hamper opening of a duct of the container blank, through which duct a filling pipe of the filling machine is to be inserted in order to transfer a product to the container blank for producing a filled container.

There is thus a need for an improved type of transport unit.

SUMMARY OF THE INVENTION

With the above in mind, it is an object of the present invention to provide an improved transport unit comprising a load carrier and a load supported by said load carrier and comprising a coil of a web being wound on a reel.

A further object of the invention is to provide a transport unit of this kind which allows for a reliable securing of the load without or with minimum deformation of the coil.

It is also an object of the invention to provide a more cost effective transport unit.

In order to achieve at least one of the above objects, and also other objects which will emerge from the following description, the present invention relates to a transport unit having the features defined in claim 1 and to a method for manufacturing of a transport unit having the features defined in claim 12. Embodiments of the inventive transport unit emerge from claims 2-11 and embodiments of the inventive method emerge from claims 13-14.

More specifically, according to a first aspect of the invention, a transport unit is provided comprising a load carrier and a load supported by said load carrier and comprising a coil of a web being wound on a reel. The transport unit is characterized by a load securing member extending inside the reel and between the load carrier and an anchoring device arranged on a top surface of the load such that the load is secured to the load carrier.

Hereby an improved transport unit is provided. The anchoring device, the reel and the load carrier form a force-absorbing structure taking up a force applied by the load securing member in order to secure the load to the load carrier. The fact that the load securing member extends inside the reel and connects to the anchoring device and to the load carrier, enables a centred and thereby very stable and reliable securing of the load to the load carrier without contact and deformation of the web. Since the load securing member only needs to have an extension inside the reel between the anchoring device and the load carrier, the usage of material making up the anchoring device may be minimized. Further, since the load securing member is arranged inside the reel and thus extends inside said force-absorbing structure, the material making up said load securing member may also be minimised. Hence, the inventive transport unit may be manufactured at a reduced cost.

According to an embodiment of the inventive transport unit, the anchoring device may have an extension across said reel. Hereby, the anchoring device may rest on a top end of the reel in order to form said force-absorbing structure.

Said web of the coil may comprise interconnected container blanks, which in turn may comprise two opposing side walls and a bottom wall.

According to another embodiment, the load may comprise a stack of coils, in which stack the reels of the respective coils are axially aligned with each other. The aligned reels will thus form a part extending through the load of the force-absorbing structure.

According to yet another embodiment, adjacent coils in the stack may be separated by a separating element. Hereby interleaving of neighbouring coils in the stack is prevented and unloading of individual coils is facilitated.

In a further embodiment of the inventive transport unit, the load securing member may be a tightening strap. Hereby a cost-efficient yet reliable and strong load securing member is provided.

According to another embodiment, the load carrier may be a pallet with deck boards supported by joist boards including a centre joist board.

The tightening strap may extend in an endless loop over the anchoring device, down and through the reel, under said centre joist board, up and through the reel, and back to the anchoring device.

The anchoring device may have a length L greater than the diameter of the reel. The anchoring device may further have a width W smaller than the diameter of the reel.

Further, according to a second aspect of the present invention, a method of manufacturing a transport unit is provided, comprising arranging a load comprising a coil of a web being wound on a reel on a load carrier, arranging an anchoring device on a top surface of the load, the anchoring device having an extension across said reel, arranging a load securing member inside the reel, connecting the load securing member to the anchoring device and to the load carrier and tightening the load securing member, thereby securing the load to the load carrier.

Hereby an improved method is obtained for manufacturing of a transport unit having the benefits previously described.

According to an embodiment of the inventive method, the load securing member may be a tightening strap and the load carrier may be a pallet with deck boards supported by joist boards including a centre joist board, wherein the step of arranging the load on the load carrier may comprise aligning the reel such that it is positioned above a gap defined by two adjacent deck boards and above said centre joist board exposed in said gap, and wherein the step of connecting the load securing member to the anchoring device and to the load carrier may comprise arranging the tightening strap in an endless loop over the anchoring device, down through the reel, under said centre joist board, up through the reel, and back to the anchoring device.

The step of the arranging the load securing member in an endless loop may include: inserting two legs of a tightening strap application device inside the reel by straddling said anchoring device, each leg having a front tip, moving the front tips of said two legs through said gap on opposing sides of said centre joist board, connecting the front tips of said two legs of the tightening strap application device by means of a connecting member, and applying the tightening strap by means of the tightening strap application device along a path defined by said two legs and the connecting member.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

Figure 1:
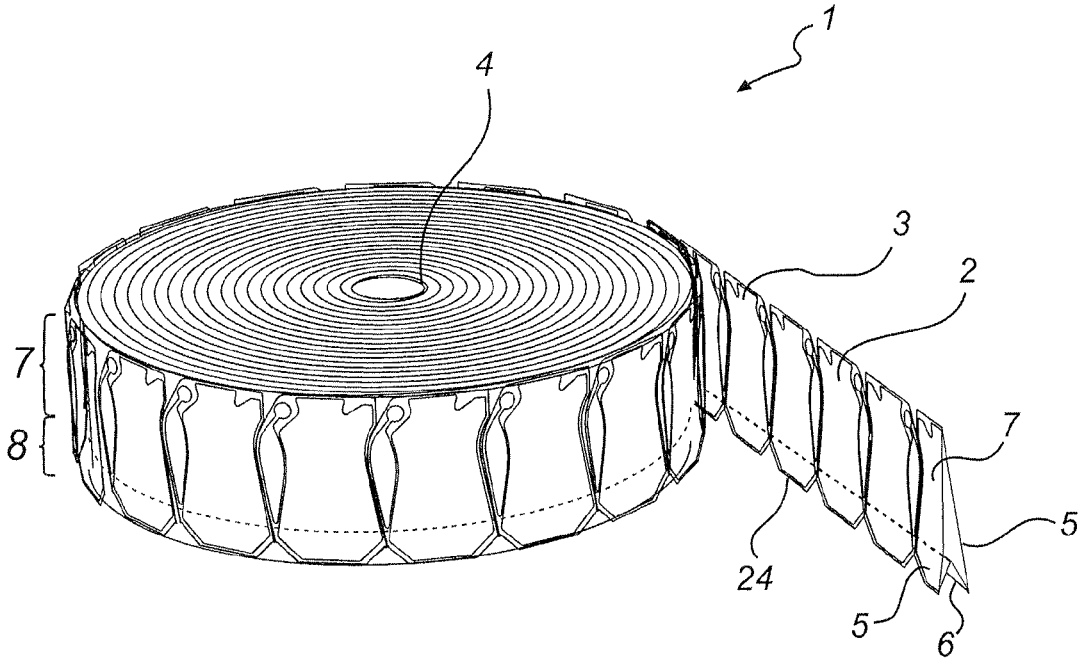
FIG. 1 is a perspective view of a coil for a load for a transport unit according to the invention.

With reference to FIG. 1, a coil 1 of container blanks 2 is schematically shown. The coil 1 comprises more specifically a web 3 of a large number of container blanks 2 which are arranged side by side and interconnected. The web 3 is wound up on a reel. An end part of the web 3 is unrolled from the coil 1 for illustrative purposes.

A container blank 2 is in this context an empty, pre-made container which is intended to be supplied to a filling machine in order to produce filled containers.

The produced container is of a collapsible type, also referred to as a container of stand-up pouch type. By this is meant a container with two side walls 5 and a bottom wall 6 of a flexible plastic material. The walls 5, 6 are interconnected along a connecting portion to define a compartment whose volume is dependent on the relative position of the walls 5,6. In the unfilled state of the container, the bottom wall 6 is folded. The container, and thus its container blank 2, is thus essentially flat. FIG. 1 shows the walls 5, 6 slightly separated for illustrative purposes.

The container blank 2 may be filled with a product in the form of liquid, such as milk, water, wine or juice, or powder in order to produce a filled container.

In the manufacture of this type of container blanks 2, a continuous web of material which may folded in the form of a M. Subsequently, the opposite wall portions are joined along what is referred to as connecting portions to form a closed compartments. The thus formed web of container blanks may then be fed to a punch station in which excess material is removed. Finally, the web 3 is wound on the reel 4 to form the coil 1. The diameter of the coil 1 is substantially greater than the diameter of the reel 4. Moreover, the diameter of the coil 1 is greater than the height of the coil 1. As an example, a coil may contain 4 500 blanks and weigh about 70 kg. A coil typically weighs between 15 and 75 kg.

The thus formed web 1 of container blanks 2 will in its transverse direction have a first portion 7 with two wall layers and a second portion 8 with four wall layers. In consequence of this difference in the number of layers, the coil 1 will have a first density in the first portion 7 and a second density in the second portion 8. This difference in density results in great difficulties during handling and transport of the coil 1. For instance, it will be very difficult to grip the coil 1. Furthermore, two coils 1 should not be stacked on top of each other since movements and vibrations during transport and handling result in the turns of the web 3 striving to interleave, thus causing damage to the web 3 of container blanks 2. A stack with this type of coils 1 will also, due to the difference in density, be unstable with the ensuing risk of tilting. Tilting may result in, for example, damage to container blanks 2 and neighbouring transport units, and also personal injuries.

Figure 2A:
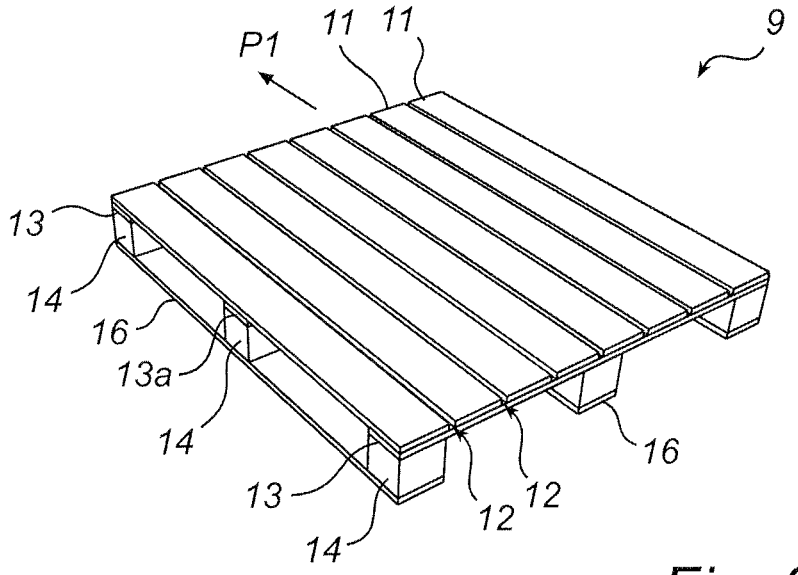
FIG. 2*a* is a perspective view from above of an embodiment of a load carrier for a transport unit according to the present invention.
Figure 2B:
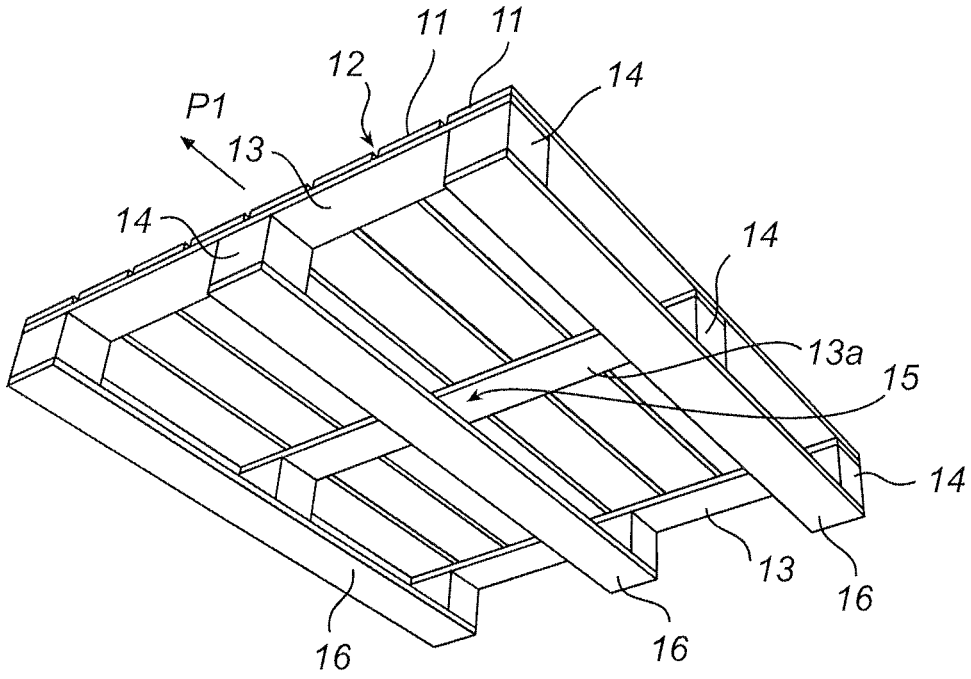
FIG. 2*b* is a perspective view from below of the load carrier in FIG. 2*a*.

With reference to FIGS. 2*a* and 2*b*, an example of a load carrier 9 of pallet type is shown. The reference to FIGS. 2*a* and 2*b* is made to define a number of terms that will be used in the description of the invention.

Staring from above, the load carrier 9 comprises a load surface 10 which in the embodiment illustrated is formed of deck boards 11. The deck boards 11 extend in the longitudinal direction P1 of the load carrier 9 and are arranged in such a manner that longitudinal gaps 12 are formed between them. The deck boards 11 are arranged on top of three joist boards 13 including a centre joist board 13*a*. The joist boards 13 are arranged transversely to the longitudinal direction P1 of the load carrier 9 and are positioned at the ends and in the centre of the load carrier 9, the one in the centre constituting said centre joist board 13*a*. On the underside of each joist board 13 there are spacer blocks 14. The spacer blocks 14 are arranged at the ends and in the centre of the two joist board 13 at the ends of the load carrier 9. Only two spacer blocks 14 are arranged on the centre joist board 13*a*, one spacer block 14 at each end. Hereby, a free space 15 is created under the deck boards 11 and the centre joist board 13*a* of the load carrier 9. Finally, three runners 16 are arranged on the underside of the spacer blocks 14. The runners 16 extend in the longitudinal direction P1 of the load carrier 9, that is in the same direction as the deck boards 11, and thus connect three groups of spacer blocks 14 seen in the longitudinal direction P1 of the load carrier 9.

The design of the load carrier is dependent on the number, size and weight of the load or loads that is/are intended to be supported by said load carrier. A load carrier of pallet form may for instance be designed to exhibit sufficient torsional stiffness by suitable choice of dimensions or material, or selection of cross-sectional geometry. Also, additional reinforcements may be provided.

Figure 3:
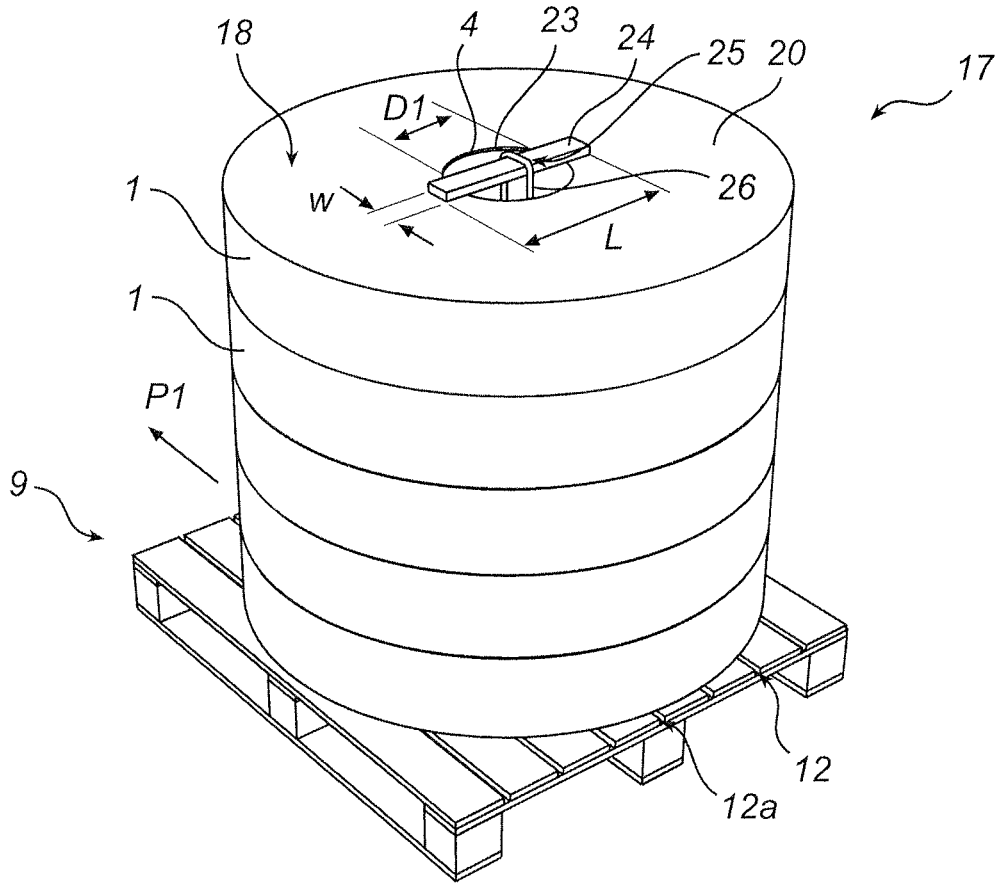
FIG. 3 is a perspective view of an embodiment of a transport unit according to the present invention.
Figure 4:
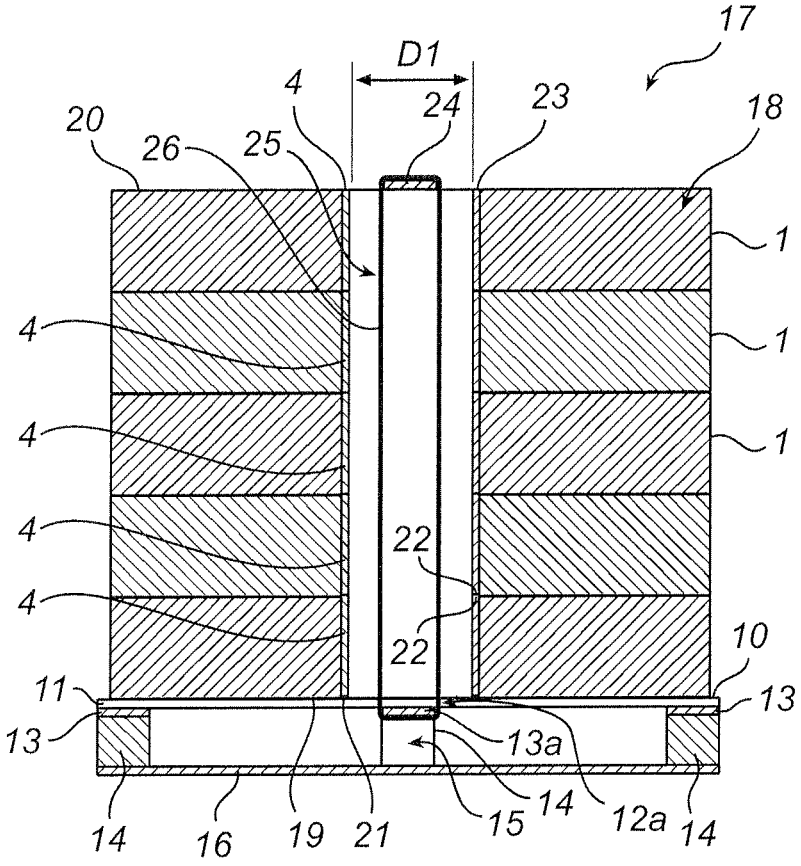
FIG. 4 is a sectional view of the transport unit shown in FIG. 3.

Reference is now made to FIGS. 3 and 4, which shows a first embodiment of a transport unit 17 according to the present invention which carries a load 18 in the form of a stack of five coils 1. The number of coils making up the load may naturally differ and may as a non-limiting example be in the range of 1-10 coils.

The transport unit 17 comprises a load carrier 9 of pallet type which has the same fundamental construction of deck boards 11, joist boards 13, spacer blocks 14 and runners 16 as the above described pallet, and will therefore not be described once more.

The load carrier can be both square and rectangular. The dimensions of the load carrier may be adjusted to the number of loads and the dimensions thereof. The width and length of the load carrier may correspond substantially to the total diameter of the load, that is the total diameter of the coils arranged on the load carrier, seen in the transverse and respectively longitudinal direction of the load carrier. Moreover, the intended means of transport, that is lorry or container, is to be taken into consideration for optimised use of the available load surface. The load carrier need not be designed as a pallet but can be designed in any other suitable manner.

In the embodiment illustrated, the load carrier 9 carries a load 18 in the form of five coils 1 of container blanks of the above-mentioned type. The coils 1 are arranged in a stack in such a manner that the reels 4 of the coils 1 are axially aligned with each other and also perpendicular to the load surface 10 of the load carrier 9.

A bottom surface 19 of the load 18, i.e. the bottom surface 19 of the coil 1 lowest in the stack, faces the load surface 10, and the load essentially rests on said load surface 10 via the lower reel end 21 of the reel 4 of said lowest coil 1.

Reel ends 22 facing each other also rest against each other, and thus the weight of the stack of coils 1 is transferred to the load carrier 9 via the aligned reels 4. However, the reel ends need not make direct contact with each other. It is thus possible to arrange a separating element between each pair of adjacent coils, which will be discussed more in detail below. What is important is that the weight of an upper coil is transferred to a lower coil through said reels.

In the case where a plurality of stacks are arranged on the load carrier (not shown), each stack forms a load.

Figure 5:
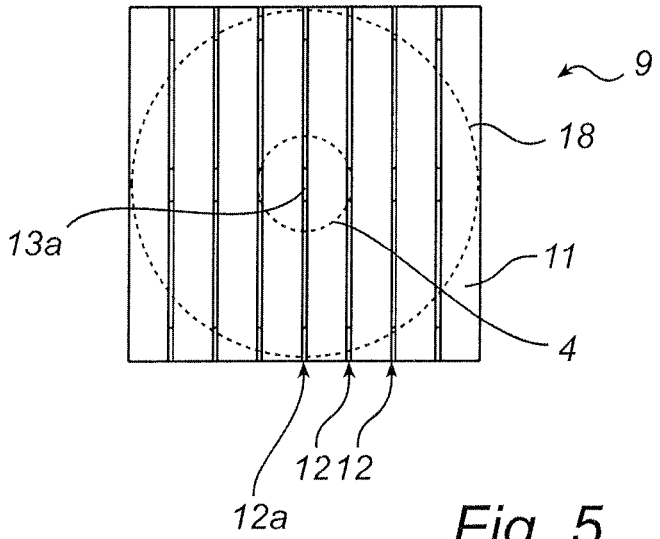
FIG. 5 is a schematic plan view of the load carrier for the transport unit shown in FIG. 3.

In the shown embodiment, the load 18 is arranged such on the load carrier 9 that the axially aligned reels 4 are positioned above one gap 12*a* of said longitudinal gaps 12 defined by two adjacent deck boards 11 and above the centre joist board 13*a* exposed in said one gap 12*a*. This is more clearly illustrated in FIG. 5, to which reference now also is made. The figure shows load carrier 9 from above, and the stack of coils and associated reels are indicated with dashed lines. More specifically, it is clearly shown that the load 18 is arranged such that the aligned reels 4 are positioned above the gap 12*a* and the centre joist board 13*a* exposed in said gap 12*a*.

An anchoring device 24 is arranged on a top surface 20 of the load and has an extension across the reels 4 of the coils 1. More specifically, the anchoring device 24 has an extension across a top reel end 23 of the reel 4 of the uppermost coil 1 in the stack.

Figure 6A:
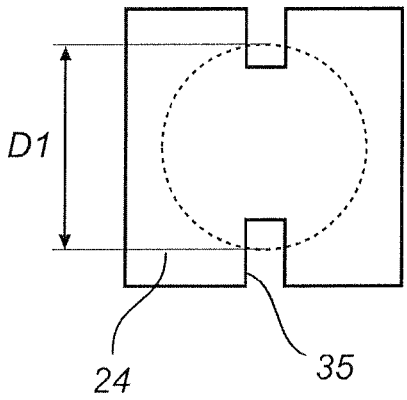
FIG. 6*a* is a plan view of an embodiment of an anchoring device for a transport unit in accordance with the present invention.

In the shown embodiment, the anchoring device has a rectangular shape and has a length L greater than the diameter D1 of the reel of the uppermost coil, and a width W smaller than said diameter D1. It is understood that the width may be equal or greater than said diameter D1, and in this case cut outs 35 may be arranged in said anchoring device 24 providing access to the interior of the reels, as shown in FIG. 6*a*.

Figure 6B:
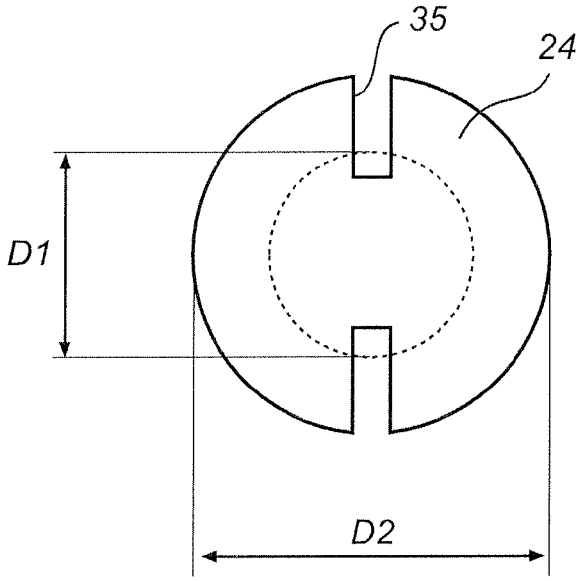
FIG. 6*b* is a plan view of another embodiment of an anchoring device for a transport unit in accordance with the present invention.

Alternatively, the anchoring device may be of another shape, such a disc shape with a diameter D2 greater than the diameter D1 of the uppermost reel. Once again, cut outs 35 may be arranged in said anchoring device 24 providing access to the interior of the reels, as shown in FIG. 6*b*.

The anchoring device 24 may be a wood board.

A common feature of the different described embodiments of the anchoring device 24 is that it is adapted to rest on the top reel end 23 of the of reel 4 of the coil 1 arranged at the top of the stack. As a result, the anchoring device 24, the reels 4 of the coils 1 arranged in the stack and also the load carrier 9 will form a force-absorbing structure that will be discussed below.

The shown embodiment of the anchoring device 24 of a rectangular shape is oriented so as to extend perpendicular to the longitudinal direction P1 of the parallel to the deck boards 11. In case the anchoring device comprises cut outs providing access to the interior of the reels, the cut outs may be provided on opposing sides of the anchoring device, which may be oriented such that the cut outs are aligned in a direction parallel to said longitudinal direction P1.

The load 18 is secured to the load carrier 9 by means of a load securing member 25. The load securing member 25 extends through the load, i.e. inside the reels 4 of the coils 1 of the stack, between the anchoring device 24 and the load carrier 9 such that the load is secured to the load carrier 9.

In the shown embodiment, the load securing member 25 is the form of a tightening strap 26. The tightening strap 26 extends in an endless loop over the anchoring device 24, down through the reels 4 and through said one gap 12*a* on a first side of said centre joist board 13*a*, under said centre joist board 13*a*, up through the gap 12*a* on a second side of said centre joist board 13*a* and through the reels 4, and back to the anchoring device 24. The free space 15 provided under the centre joist board 13*a* in the centre of the load carrier 9, allows for the extension of the tightening strap 26 under said centre joist board 13*a*.

With this type of securing, the securing force applied by the load securing member 25 will act through the force-absorbing structure defined above without affecting the top surface 20 of the load 18, that is without the tightening strap 26 engaging the webs 3 of container blanks 2 wound on the reels 4.

The force-absorbing structure formed by the anchoring device 24, the reels 4 and the load carrier 9, will act for efficient absorbing of a tightening force applied by the tightening strap 26 and, thus a very reliable securing of the load 18 is achieved.

The tightening strap 26 suitably consists of materials that are available on the market, such as plastic or steel. A suitable strap tension is 800-1200 N, and more preferred 900-1100 N.

Figure 7:
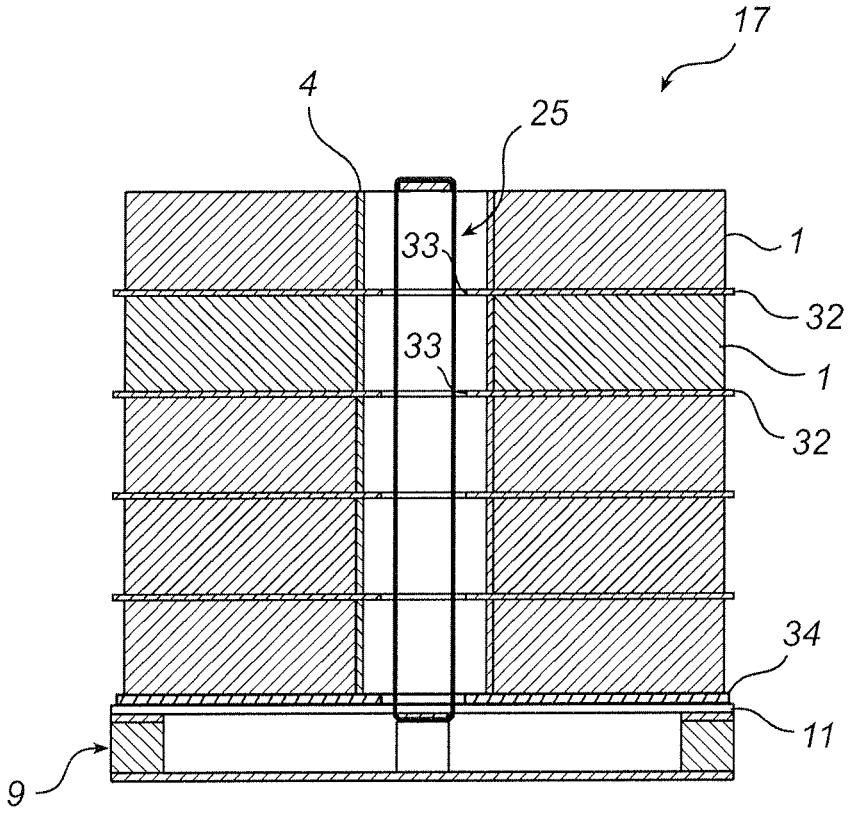
FIG. 7 is a sectional view of another embodiment of a transport unit in accordance with the present invention.

In the case where the coils 1 are arranged on the load carrier 9 in stacks, separating elements 32 may be arranged between the individual coils 1 of the stack, as shown in FIG. 7. The separating element 32 may have the form of a plate and aims substantially at avoiding interleaving between the turns of the web 3 of two neighbouring coils 1. The separating element can be made of, for instance, wood or cardboard and may exhibit a centre hole 33 for allowing passage of the load securing member 25 inside the reels 4 of the coils 1. Alternatively, the separating element may be arranged to be perforated in connection with application of the load securing member through the load. The separating element 32 also facilitates unloading of the coils 1 from the transport unit 17. The separating element 32 allows the coils 1 to be easily pushed off from the transport unit 17 without the risk of interleaving between turns of the web of two neighbouring coils 1.

Alternatively, the individual coil may be arranged in a plastic bag (not shown) which also prevents interleaving and facilitates unloading. The plastic bags will be perforated in connection with application of the load securing member through the load.

In order to further protect the coils 1 from environmental influence, the load carrier 9 may comprise a protective layer 34 in the form of, for instance, a film, paper or sheet which is arranged directly on the deck boards 11 to provide protection against dirt and moisture from the underside of the load carrier 9.

The transport unit may be provided with a cover enclosing the load (not shown). The purpose of the cover is to protect the load during transport, handling and storage, especially if the individual coils are not arranged in plastic bags.

It is understood that the load carrier may be arranged to support more than one load. For instance, an inventive transport unit may comprise a load carrier arranged to support four loads. Such a load carrier may be of pallet type having two centre joist boards arranged at a suitable mutual distance, each centre joist board being used in order to secure two of said four loads.

The inventive transport unit has a number of advantages. The anchoring device, the reel/reels and the load carrier together form a force-absorbing structure which together with the load securing member enables securing of the load to the load carrier which is very gentle on the web of container blanks. The load securing member in the form of the tightening strap can enclose the force-absorbing structure and secure the load to the load carrier without any risk of upsetting the web of container blanks. This means that coils of container blanks of the above-mentioned type, despite their instability caused by their difference in density, can be loaded and transported in this type of transport unit without being damaged due to upsetting or interleaving, whether the load consists of individual coils or a plurality of stacked coils.

The fact that the load securing member extends inside the reel or reels and connects to the anchoring device and to the load carrier, enables a centred and thereby very stable and reliable securing of the load to the load carrier without contact and deformation of the web.

The fact that the load securing member extends inside the reel or reels also means that the anchoring device needs only have an extension across said reel, and not across the entire load. Thus, the material making up the anchoring device may be minimized. Also the material making up the load securing member may be minimized since there is no need for it to enclose the entire load but instead to extend inside the load.

With reference to FIGS. 8*a*-8*g*, to which reference now is made, a method of manufacturing a transport unit according to the present invention will be described.

Figure 8A:
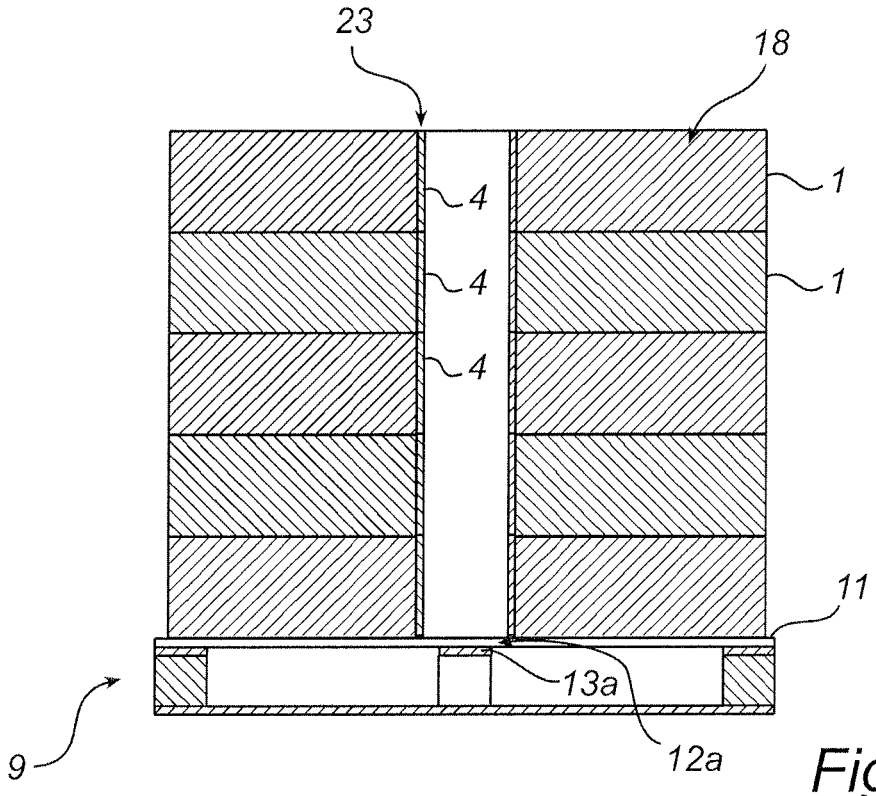
FIGS. 8*a*-8*g* schematically illustrate steps for manufacturing a transport unit in accordance with the present invention.

In FIG. 8*a*, a load carrier 9 in the form of a pallet is shown upon which a load 18 has been arranged. The load carrier 9 is of the same type as the one described above with reference to FIGS. 2*a* and 2*b*. The load 18 comprises five coils 1 arranged in a stack. The reels 4 of the coils 1 are aligned and arranged such that they are positioned above a longitudinal gap 12*a* defined by two adjacent 11 deck board of the pallet 9 and also above a centre joist board 13*a* exposed in said longitudinal gap 12*a*.

Figure 8B:
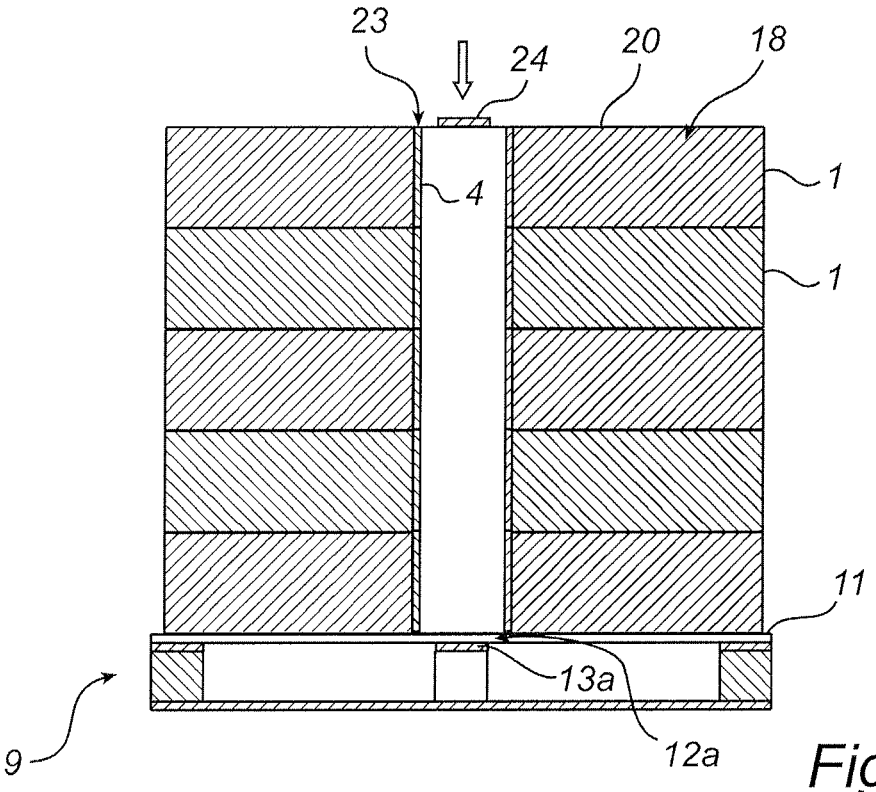

In FIG. 8*b*, an anchoring device 24 in the form of a wood board has been arranged on a top surface 20 of the load 18. More specifically, the wood board 24 is placed such that it has an extension across a top reel end 23 of the uppermost reel 4. The wood board 24 has a length greater than the diameter of the reels 4 and a width smaller than said diameter, as previously has been described.

Figure 8C:
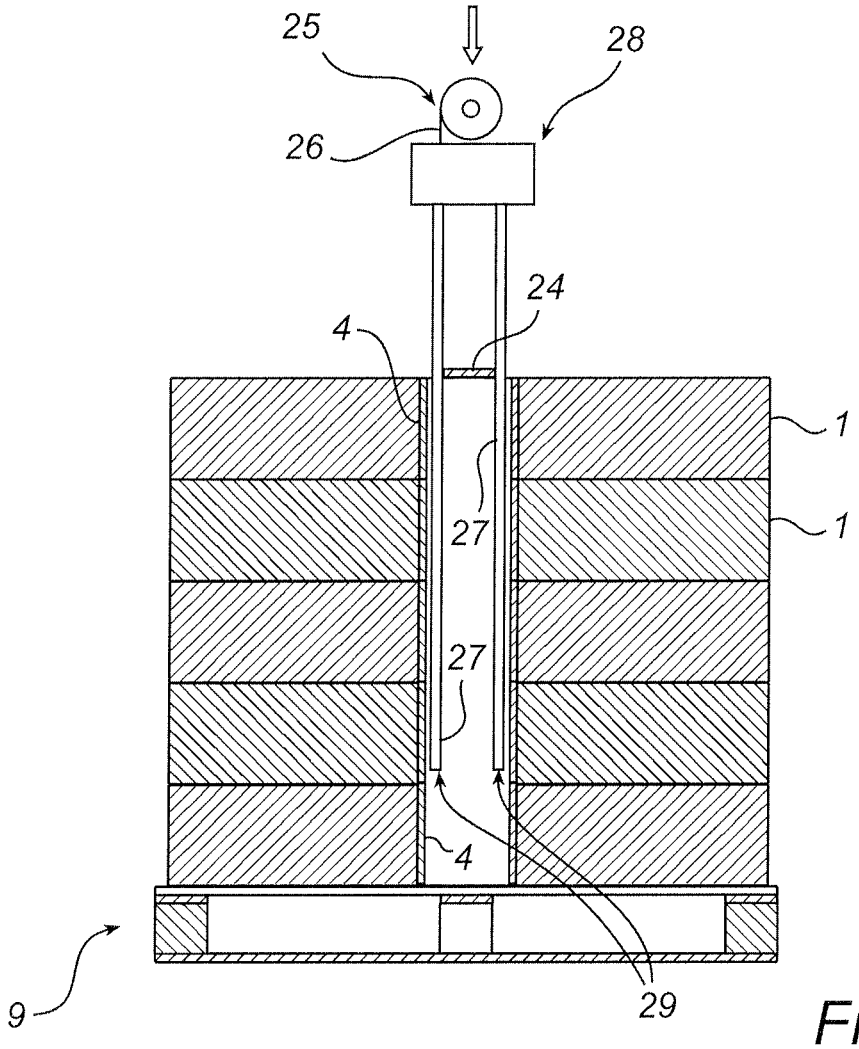

In FIG. 8*c*, the step has been initiated of arranging a load securing member 25 in the form of a tightening strap 26 inside the reels 4 and connecting it to the wood board 24 and to the pallet 9. More specifically, two legs 27 of a tightening strap application device 28 have been inserted inside the reels 4 of the coils 1 by straddling the wood board 24. Albeit the specific design of the tightening strap application device as well as the path along which the tightening strap application device is arranged to apply the tightening strap is believed to be unique, the general working principle of the tightening strap application device is of conventional type.

Figure 8D:
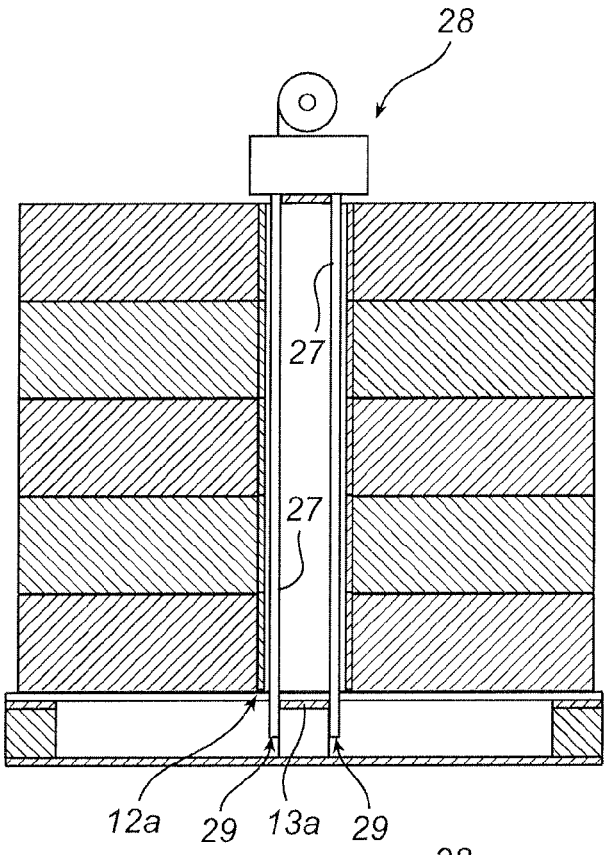

In FIG. 8*d*, the two legs 27 of the tightening strap application device 28 have been moved such that a front tip of 29 each leg 27 has been led through said longitudinal gap 12*a* on opposing sides of said centre joist board 13*a*.

Figure 8E:
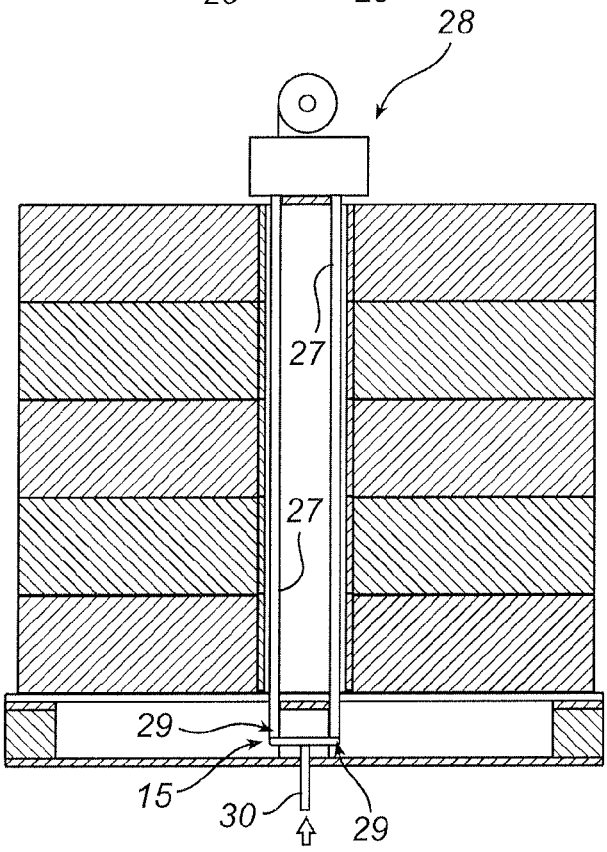

In FIG. 8*e*, a connecting member 30 have been moved to the free space under 15 the centre joist board 13*a*. The connecting member 30 connects the front tips 29 of the two legs 27.

Figure 8F:
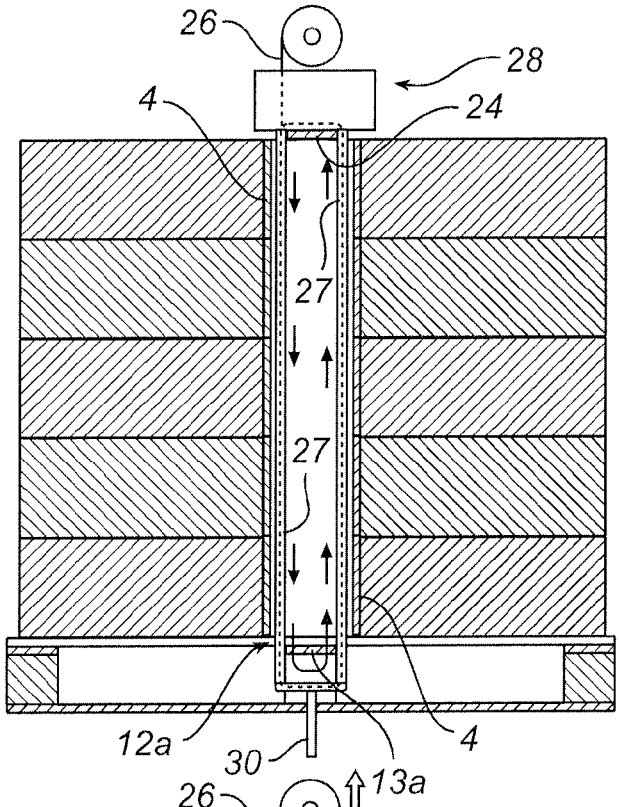

In FIG. 8*f*, the tightening strap 26 is applied by the tightening strap application device 28 along a path defined by said legs 27 and said connecting member 30. More specifically, the tightening strap 26 is led through a first of said two legs 27, on one side of the wood board 24, down inside the reels 4, through the gap 12*a* and further through the connecting member 30 under the centre joist board 13*a*. The tightening strap 26 is then fed through a second of said two legs 27, up inside the reels 4 and up on the other side of the wood board 24.

Figure 8G:
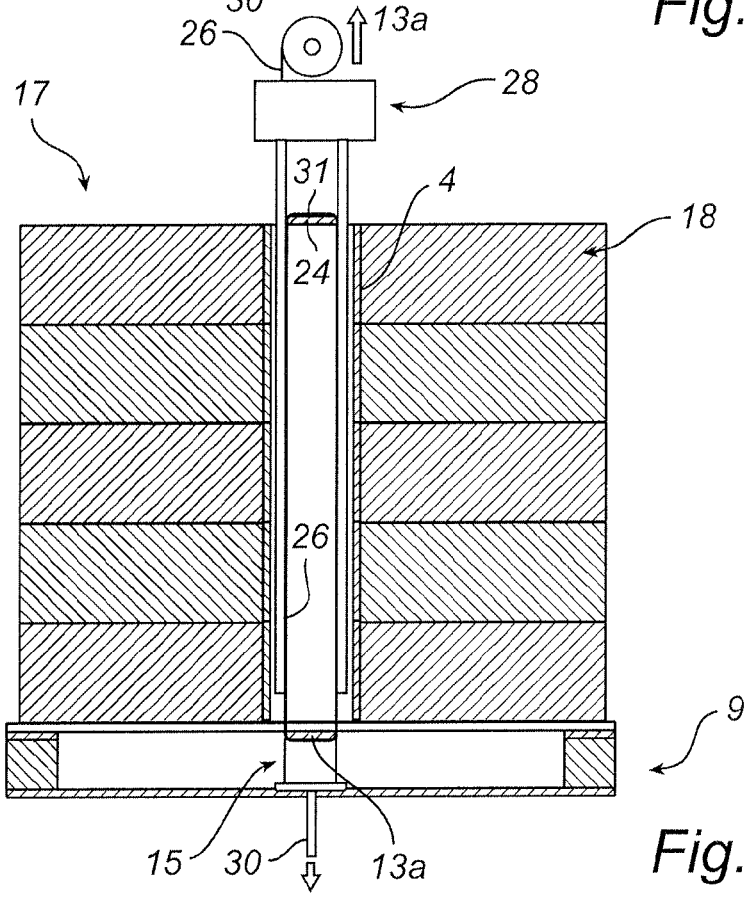

In FIG. 8*g*, the tightening strap application device 28 has cut the tightening strap 26 to a suitable length, tightened it, and joined the free ends of the tightening strap 26 at a joint 31. The tightening strap application device 28 is further being pulled out of the reels 4 and the connecting member 30 is also moved from the free space 15 under the centre joist board 13*a*.

The tightening strap 26 thus extends in an endless loop over the anchoring device 24, down and through the reels 4, under said centre joist board 13*a*, up and through the reels 4, and back to the anchoring device 24. The tightening strap 26 exerts a tightening force absorbed by the force-absorbing structure formed by the anchoring device 24, the reels 4 and the load carrier 9 securing the load 18 to the load carrier 9. Thus a transport unit 17 has been manufactured.

Tests according to ASTM D 4169-04a, DC2 have been performed at the Swedish institute STFI-Packforsk. This standard comprises, inter alia, a number of different drop tests and collision tests. The tests have demonstrated that a transport unit with the above described force-absorbing structure makes it possible to meet the requirements stipulated according to this standard. As a result, transport units manufactured according to the inventive method meet the current requirements in order for the forwarding agent to be liable to pay damages for any transport-related damage to the transport unit and its load.

It will be appreciated that the present invention is not limited to the illustrated embodiments and method steps.

For instance, the load securing member may be given a different design. It is thus possible to replace the load securing member in the form of a tightening strap with a load securing member in the form of a long screw member. Such a screw member may be inserted through a hole in an anchoring device in the form of a disc with a diameter greater than the diameter of the reels. A washer may be provided between the screw head and the disc. The screw extends inside the reels and is screwed in the load carrier. In case the load carrier is in the form of a pallet, the reels may be aligned such that the screw is screwed through one of the deck boards, through the centre joist board and into a spacer block arranged under said centre joist board The load carrier in the form of a pallet may thus in this case be of a different design than of that described above with reference to FIGS. 2*a* and 2*b*.

Several modifications and variants are conceivable and the invention is consequently defined exclusively by the appended claims.

The invention claimed is:

1. A transport unit comprising:

a rectangular or square load carrier for supporting a load having a coil of a web wound on a reel;

a load supported by said load carrier;

a load securing member extending inside the reel and between the load carrier and an anchoring device arranged on a top surface of the load such that the load is secured to the load carrier;

wherein the load securing member comprises a tightening strap;

wherein the load carrier comprises a pallet with deck boards extending in a longitudinal direction of the load carrier and being supported from below by joist boards including a center joist board, wherein the joist boards are arranged transversely to the longitudinal direction;

wherein the load is arranged on said load carrier such that the reel is positioned above a longitudinal gap defined by two adjacent deck boards and above said center joist board which is exposed in said longitudinal gap; and wherein said tightening strap extends in an endless loop over the anchoring device, down and through the reel, through the longitudinal gap defined by the two adjacent deck boards, under said center joist board, up and through the reel, and back to the anchoring device.

2. A transport unit according to claim 1, in which said anchoring device extends across the end of said reel.

3. A transport unit according to claim 1, in which said web comprises interconnected container blanks.

4. A transport unit as claimed in claim 3, in which each container blank comprises two opposing side walls and a bottom wall.

5. A transport unit as claimed in claim 1, in which the load comprises a stack of coils, in which stack the reels of the coils are axially aligned with each other.

6. A transport unit as claimed in claim 5, in which adjacent coils in the stack are separated by a separating element.

7. A transport unit as claimed in claim 1, wherein the anchoring device has a length greater than the diameter of the reel.

8. A transport unit as claimed in claim 1, wherein the anchoring device has a width smaller than the diameter of the reel.

9. A transport unit according to claim 2, in which said web comprises interconnected container blanks.

10. A transport unit as claimed in claim 9, in which each container blank comprises two opposing side walls and a bottom wall.

11. A transport unit as claimed in claim 2, in which the load comprises a stack of coils, in which stack the reels of the coils are axially aligned with each other.

12. A transport unit as claimed in claim 11, in which adjacent coils in the stack are separated by a separating element.

13. A transport unit as claimed in claim 2, wherein the anchoring device has a length greater than the diameter of the reel.

14. A transport unit as claimed in claim 2, wherein the anchoring device has a width smaller than the diameter of the reel.

15. A transport unit as claimed in claim 3, in which the load comprises a stack of coils, in which stack the reels of the coils are axially aligned with each other.

16. A transport unit as claimed in claim 15, in which adjacent coils in the stack are separated by a separating element.

17. A transport unit as claimed in claim 3, wherein the anchoring device has a length greater than spans across the diameter of the reel.

18. A transport unit as claimed in claim 3, wherein the anchoring device has a width smaller than the diameter of the reel.

19. A transport unit as claimed in claim 1, wherein the tightening strap extends around the bottom of the center joist board.

* * * * *